US006551373B2

(12) United States Patent
Alcini et al.

(10) Patent No.: US 6,551,373 B2
(45) Date of Patent: Apr. 22, 2003

(54) COPPER INFILTRATED FERRO-PHOSPHOROUS POWDER METAL

(75) Inventors: William Victor Alcini, Ypsilanti, MI (US); Thomas George Fleming, St. Marys, PA (US)

(73) Assignees: NTN Corporation, Osaka (JP); Metco Industries, Inc., St. Marys, PA (US)

( * ) Notice: Subject to any disclaimer, the term of this patent is extended or adjusted under 35 U.S.C. 154(b) by 0 days.

(21) Appl. No.: 09/843,469

(22) Filed: Apr. 26, 2001

(65) Prior Publication Data

US 2002/0027218 A1 Mar. 7, 2002

Related U.S. Application Data

(60) Provisional application No. 60/203,215, filed on May 11, 2000.

(51) Int. Cl.[7] ..... C22C 1/04
(52) U.S. Cl. ..... 75/246; 419/27
(58) Field of Search ..... 75/230, 246; 419/27

(56) References Cited

U.S. PATENT DOCUMENTS

| | | | | | |
|---|---|---|---|---|---|
| 4,430,295 | A | | 2/1984 | Jandeska, Jr. | 419/46 |
| 4,485,147 | A | * | 11/1984 | Nishino et al. | 428/550 |
| 4,556,533 | A | | 12/1985 | Oaku et al. | 419/11 |
| 4,561,889 | A | | 12/1985 | Oaku et al. | |
| 4,561,893 | A | | 12/1985 | Takajo | 75/251 |
| 4,588,441 | A | | 5/1986 | Ikenoue et al. | 75/230 |
| 4,702,771 | A | | 10/1987 | Takagi et al. | 75/241 |
| 4,728,462 | A | | 3/1988 | Miller et al. | 252/513 |
| 4,749,549 | A | | 6/1988 | Hornung et al. | 420/578 |
| 4,769,071 | A | * | 9/1988 | Klar et al. | 75/246 |
| 4,824,734 | A | | 4/1989 | Takajo | 428/570 |
| 4,828,614 | A | | 5/1989 | Miller et al. | 106/1.22 |
| 4,976,778 | A | * | 12/1990 | Berry et al. | 75/246 |
| 5,024,815 | A | | 6/1991 | Ohashi et al. | 420/487 |
| 5,071,494 | A | | 12/1991 | Ohashi et al. | 148/411 |
| 5,147,469 | A | | 9/1992 | Kanzaki et al. | 148/684 |
| 5,205,878 | A | | 4/1993 | Kanzaki et al. | 148/684 |
| 5,259,860 | A | | 11/1993 | Ikenoue et al. | 75/231 |
| 5,656,787 | A | * | 8/1997 | Shivanath et al. | 75/228 |
| 5,918,293 | A | | 6/1999 | Lindberg et al. | 75/246 |
| 5,925,836 | A | * | 7/1999 | Krause et al. | 75/246 |

OTHER PUBLICATIONS

Materials Standards for P/M Structural Parts—2000 Edition, Published by Metal Powder Industries Federation pp. 1, 14, 15, 22, 23, 30, 31, 38, 39, 40, 41, 48, 49, 56, 57.

* cited by examiner

*Primary Examiner*—Ngoclan Mai
(74) *Attorney, Agent, or Firm*—Brinks Hofer Gilson & Lione

(57) ABSTRACT

In accordance with the teachings of the present invention a structural member is formed by iron-phosphorous alloy powder having about 0.01 wt % to 1.2 wt % of phosphorous by weight of the powder. The powder is then pressed to the desired matrix density and copper infiltrated such that copper is present in the amount of 1.96 wt % to 23.08 wt %, by weight of the weight of the structural member. The final density of the structured member is in a range of 6.1 to 8.1 g/cc. The structural member formed using the sintered powder metal of the present invention has superior elongation (as much as 10.3% elongation), impact strength (159 N-m charpy unnotched), tensile strength (530 MPa), and modulus (166 GPa) as compared to standard density powder metal.

33 Claims, 4 Drawing Sheets

(1 of 4 Drawing Sheet(s) Filed in Color)

COPPER INFILTRATED FERRO-PHOSPHOROUS POWDER METAL

RELATED APPLICATIONS

This application is claiming priority from. U.S provisional patent application Serial No. 60/203,215 filed on May 11, 2000.

TECHNICAL FIELD OF THE INVENTION

This invention generally relates to an article formed of an iron base powder metal. More specifically, this invention relates to an article formed using an iron phosphorous powder metal compressed and then copper infiltrated during the sintering process.

BACKGROUND OF THE INVENTION

Powder metal materials are used to produce many devices, such as medical, automotive and aerospace devices that have a need for net-shaped components that may be simple or complex in shape. Powder metal components are typically produced through a sintering process of the metal powders. The composition and processing of the material are one of the most significant factors in the determination of the physical properties that the finished powder metal component will exhibit.

There have been many combinations of powder metal materials developed that exhibit various mechanical properties necessary for different applications. However, to achieve superior mechanical properties, powder metal components have been manufactured using a variety of processes such as powder forging, double pressed double sinter, etc are required. However, components made using any of the above-mentioned processes are prohibitively expensive for many production uses.

In view of the foregoing, there is a need to provide a powder metallurgy material that yields improved mechanical performance. Preferably, the metal powder component is manufactured using a single press and single sinter process. It is also preferable that the article formed from the present invention when compared with materials made from similar process having a matrix density of less than or equal to 7.3 g/cc, exhibit superior mechanical and physical properties.

BRIEF SUMMARY OF THE INVENTION

The present invention is a new powder metallurgy material with superior mechanical properties. The specific combination of materials such as phosphorus iron infiltrated with copper during sintering creates a composite with significantly better mechanical properties than current powder metal composites or alloys also manufactured using the single press and single sinter process. The superior physical and mechanical properties of the component made using the present invention and the amount of copper infiltrated into the matrix for a given matrix density suggest that the addition of phosphorous to the iron based powder infiltrated with copper has a chemical and kinetic synergy. It is believed that phosphorous is a flux that aids copper wetting to the iron and improves copper penetration into the porosity of the matrix. Decreased porosity and rounded pores improves impact and elongation properties while the copper increases the iron matrix's strength. Normally carbon would be used to increase iron strength, however, with the phosphorous present, a significant amount of carbon would decrease impact strength and elongation properties. Therefore, diffused copper increases the iron matrix's strength instead of carbon in the invention material. It is also theorized that when using ferro-phosphorous powder as a source of phosphorous, the liquid phase sintering, may act as a transport mechanism and improve copper infiltration. It is also believed that the phosphorous increases copper wetting of the matrix particles.

BRIEF DESCRIPTION OF THE DRAWINGS

The application file contains at least one drawing executed in color. Copies of this patent application publication with color drawing will be provided by the office upon request and payment of the necessary fee.

Further features and advantages of the invention will become apparent from the following discussion and accompanying drawings, in which.

DETAILED DESCRIPTION OF THE INVENTION

The following description of the preferred embodiment is merely exemplary in nature, and is in no way intended to limit the invention or its application or uses.

The present invention is a powder metal material that exhibits superior elongation, superior impact strength, greater tensile strength and/or increased modulus than the best performing powder metal alloys manufactured from the process of single press and single sinter and having a matrix density of less than or equal to 7.3 g/cc.

Figure 1:
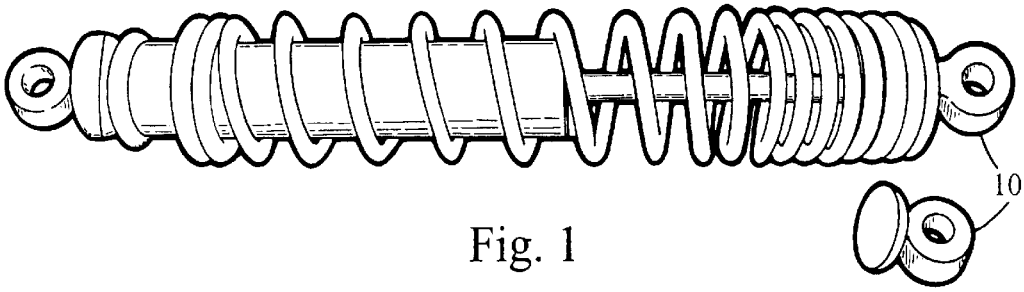
FIG. 1 is a perspective representation of a structural member formed from the metal powder in accordance with the teachings of the present invention.

Referring in particular to the drawings, a structural article formed of copper infiltrated iron phosphorous composite (also referred to as the composite throughout the application) of the present invention is generally represented by reference numeral 10. As shown in FIG. 1 the article 10 is an eyelet, which attaches the end of a shock absorber to the frame of a snow mobile vehicle. The article 10 as represented in FIG. 1 is only an example of one of the structural member formed using the composite, the present composite may be used to form a variety of structural members having complex geometry.

The article 10 formed of copper infiltrated iron phosphorous composite typically is ferro-phosphorous intermetallic compound mixed with iron powder as a starting material. Alternatively, it may be possible to produce a prealloyed phosphorous iron before making a powder or a mix of phosphorous powder or phosphorous compound with iron. It is also possible to use any combination that includes iron and phosphorus or iron or an iron alloy without phosphorus where the phosphorus is added later as the starting material.

In order to have the article 10 with the desired mechanical strength, the amount of phosphorous powder present by weight is generally the effective amount required to aid wetting of the copper to the iron (as will be explained in detail) or act as a liquid phase carrier. Therefore, the phosphorous present in the iron-phosphorous powder is theorized to act as a flux agent or liquid phase carrier to improve copper infiltration into the matrix. Typically, the effective amount of phosphorous is in the range of 0.01 wt % to 1.2 wt % of the iron-phosphorous powder. As will be explained in details later, the iron-phosphorous powder is compressed to a matrix or a preform. Typically, the preform has the desired shape of the final structural member 10.

The composition of the article 10 also comprises copper, either in form of pure copper, copper mix or copper alloy in an amount of 1.96 wt % to 23.08 wt % of the article 10. As will be explained in detail the iron is infiltrated with copper during sintering of the iron-phosphorous matrix. The final density of the article 10 typically depends on the amount of copper that is infiltrated into the iron-phosphorous matrix and the amount of expansion during sintering. The final composition of the article 10 is as follows: 1.96 wt % to 23.08 wt % Cu, 0.01 to 1.0 wt % P with the balance essentially iron. The article 10 after copper infiltration has a final density in the range of 6.1 to 8.1 g/cc.

Preferably, the article 10 formed of the copper infiltrated iron-phosphorous composite has an elongation of about 4.0% to 30.0%, tensile strength in the range of 310 MPa to 690 MPa, yield strength in the range of 220 MPa to 655 MPa, modulus in the range of 138 GPa to 207 GPa and an impact strength of about 20 N-m unnotched Charpy to 203 N-m notched Charpy.

Figure 2:
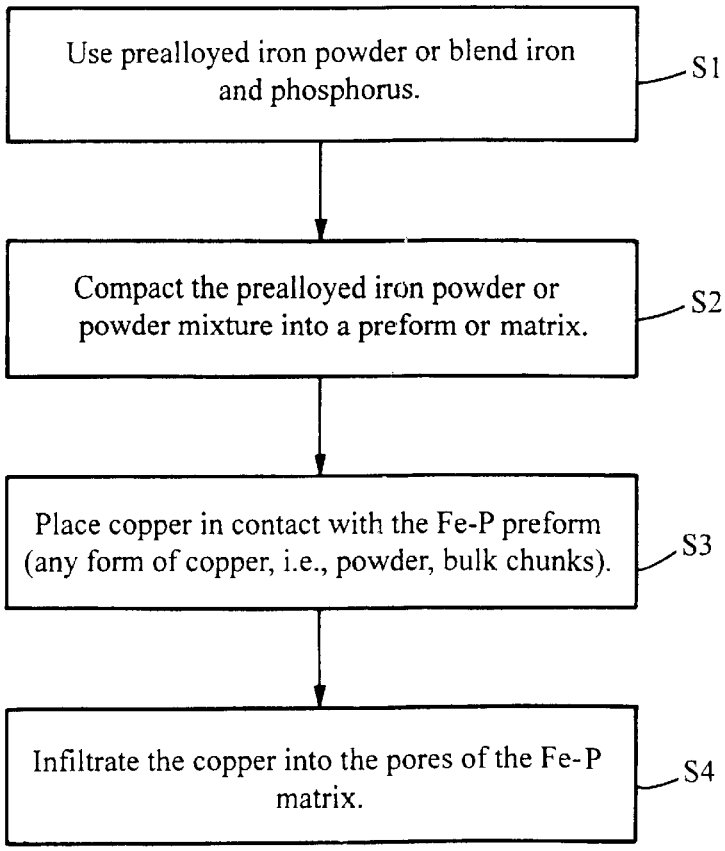
FIG. 2 is a flow chart representation of the process in forming the structural member from the metal powder in accordance with the teachings of the present invention.
Figure 3:
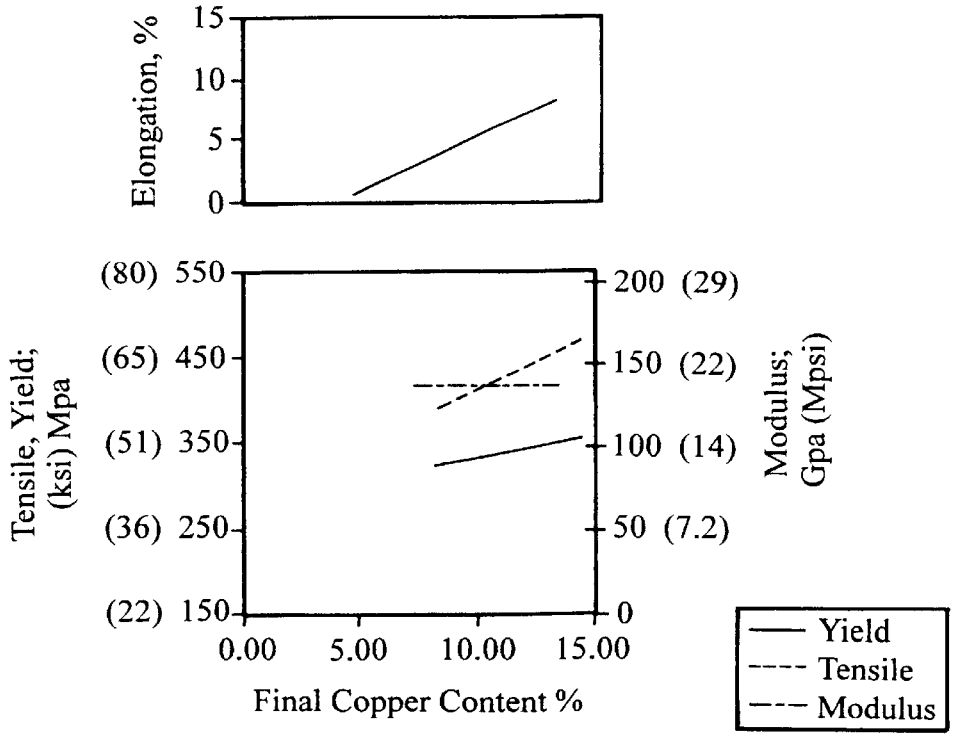
FIG. 3 is a representation of the measured mechanical properties for a 6.5 g/cc density matrix of the compacted iron-phosphorous shown at various levels of infiltrated copper yielding a range of final density, in accordance with the teachings of the present invention.

FIG. 2 illustrates the process of forming the article 10 from copper. infiltrated iron-phosphorous composite in accordance with the teachings of the present invention. As illustrated in step S1, ferro-phosphorous powder is blended with iron powder and used as the starting material or alternatively, ferro-phosphorous compound is blended with iron powder. As discussed above, the addition of phosphorous to iron helps increase copper wetting to iron. Therefore, the effective amount of phosphorous present in the iron phosphorous powder metal is the amount that would facilitate the function of the phosphorous as a fluxing agent and/or kinetic transport for the infiltration of the copper and yields optimal mechanical strength, Typically, the amount of phosphorous present is in the range of 0.01 wt % to 1.2 wt %, of the weight of the mixture of the iron-phosphorous powder metal. The balance of the composition of the iron-phosphorous metal powder is essentially iron. The following pre-prepared iron-phosphorous metal powder commercially available from Hoeganaes, Inc under the trademark ANCORSTEEL® 45P could be used as the starting material. It is also preferred that the iron-phosphorous powder metal that is used as the starting material does not contain more than 0.50 wt % Carbon. Carbon present in excess of the amount identified above will decrease the elongation and impact strength.

The process then proceeds to step S2 wherein the mixture of iron-phosphorous powder comprising the effective amount of phosphorous is introduced into a die and compacted using well-known powder metal processing techniques. Briefly stated, the iron-phosphorous powder is introduced in a die having the desired shape of the final the article 10. The iron-phosphorous powder metal is then compressed in the die to a higher density, commonly known as the green form or matrix form that is later infiltrated. Typically, a higher forming force produces more compression of metal powder and a higher density of the matrix form. The iron-phosphorous matrix is compressed to a density of 6.0 g/cc to 7.3 g/cc, preferably in the range of 6.5 g/cc to 7.0 g/cc.

Next, the desired amount of copper, copper alloy or mix is prepared in any number of forms, i.e. a ring, several small blocks, etc. and placed in contact or proximity with the matrix form, as shown in step S3 of FIG. 2. Preferably, the copper is placed on top of the matrix such that the copper may infiltrate the pores of the matrix. The amount of copper placed in contact or proximity with the matrix is the amount of copper required after infiltration in an amount in the range of 1.96 wt % to 23.08 wt % of the article 10. Typically, the amount of copper placed on top of the matrix before infiltration is in the range of 2.0 wt % to 30.0 wt % of the iron-phosphorous matrix. It is also possible that phosphorous could be added to the copper and used during infiltration as a method of introducing phosphorous to the composite.

Figure 5:
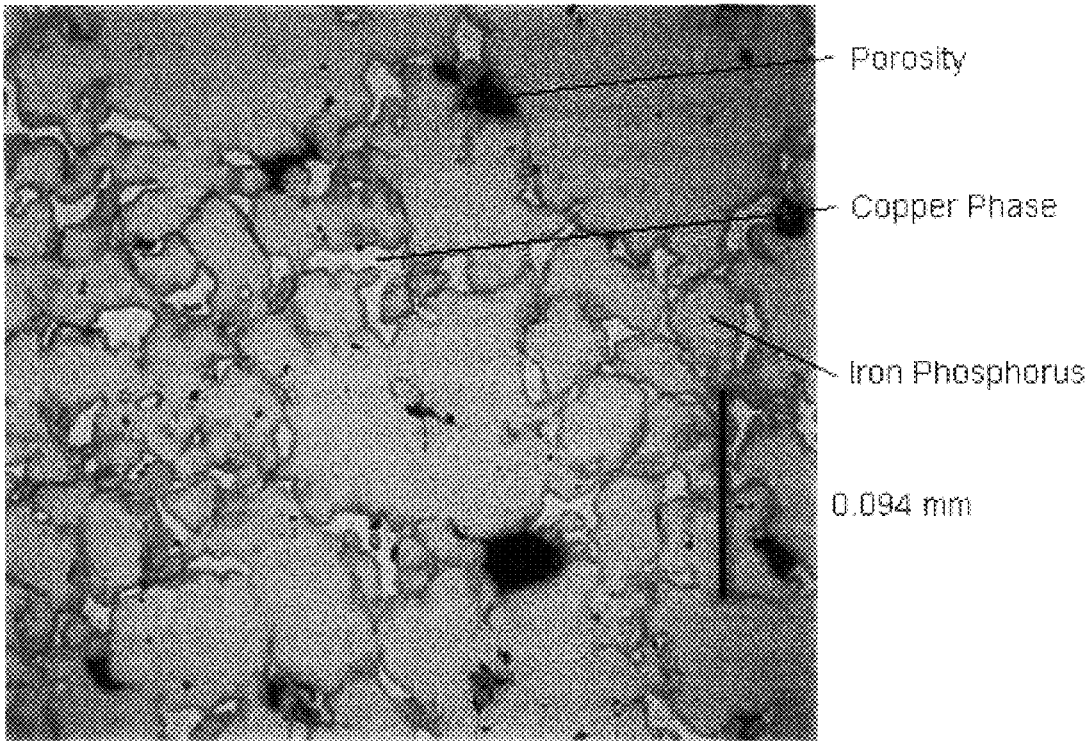
FIG. 5 is a photomicrograph depicting the copper having infiltrated into the pores of the iron-phosphorous matrix.
Figure 6:
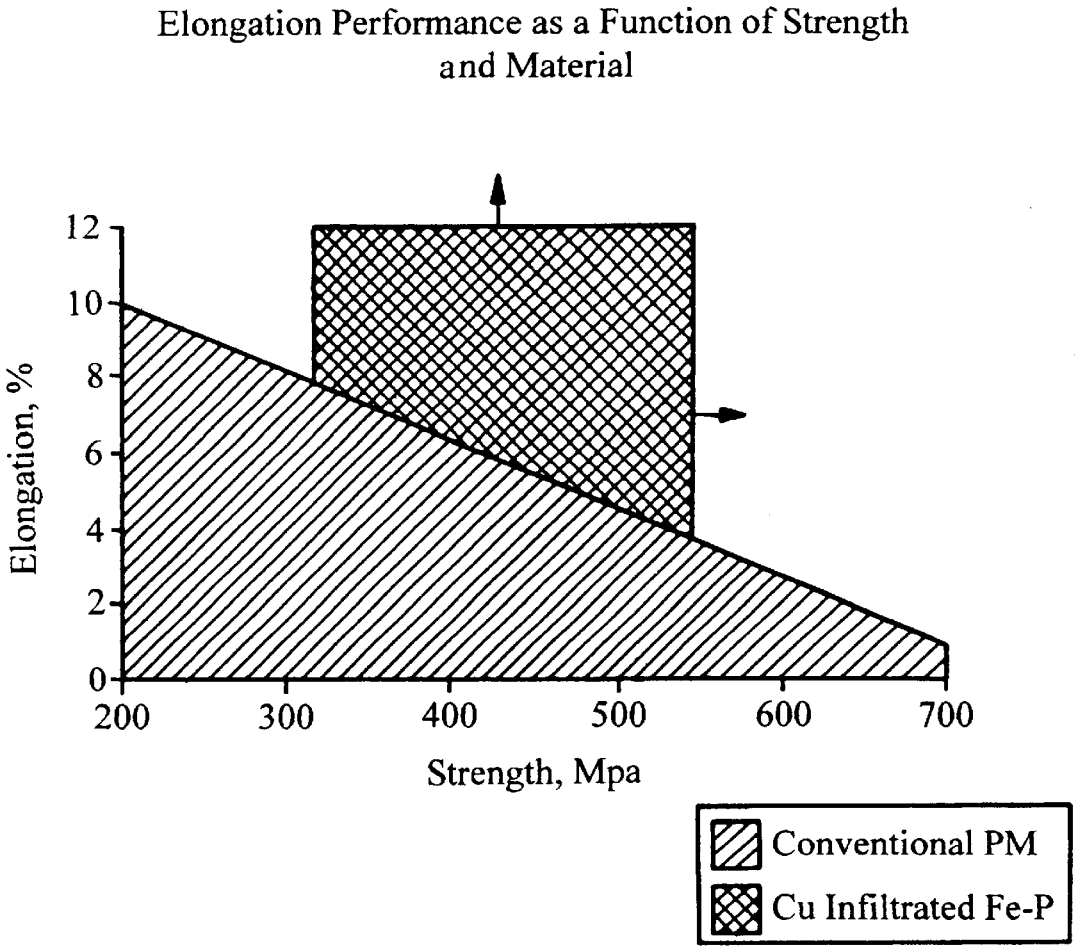
FIG. 6 is a graphical representation of the materials of the prior art and the material of the present invention.

The matrix, having a density in the range of 6.0 g/cc to 7.3 g/cc and the copper placed in contact with the matrix is then subject to a sintering process as shown in step S4 of FIG. 2. The sintering process is conventional in the art and is performed at a predetermined temperature for a fixed amount of time. Typically, the sintering process promotes the bonding or diffusion between the powder particles. With ferro-phosphorus powder as the phosphorous source, sintering causes the formation of a eutectic liquid phase in the initial stages of sintering beginning at 1050 deg. C. The formation of a liquid phase brings about quick distribution of phosphorus throughout the iron skeleton by capillary action and grain boundary penetration. The melt is quickly depleted of phosphorus and solidifies, whereupon homogenization takes place by volume diffusion. It is theoretically possible that other forms of the components, namely iron and phosphorous, may be used or prealloyed iron-phosphorous particles that diffuse with each other. In accordance with the present invention, during the sintering process, the copper flows into the iron-phosphorous matrix. The copper melts and wicks, via surface tension and capillary action, into the open porosity of the matrix. Therefore, liquid phase bonding of iron particles occurs by melting and alloying of iron phosphorous powder, molten copper also fills the pores of the iron-phosphorous matrix, thereby increasing the density and integrity of the structural member 10, as shown in FIG. 5. The amount of copper infiltrated depends on the physical and mechanical properties that are desired in the article 10; therefore, it is possible that copper does not fill all the pores in the matrix. When only a partial infiltration into the matrix is desired, the amount of copper preload is reduced. Other methods of sintering are possible such as two sintering passes, one pass to sinter the matrix and a second sinter to copper infiltrate. Also, mechanical additions or removal of the copper at any point during the sintering could be implemented. This allows more control of and independent control of diffusion and infiltration. Alternatively, it is possible to infiltrate the copper after the sintering process. Alternatively, it is also possible that the copper is infiltrated in a localized area of the matrix. After copper infiltration and the sintering process, the amount of copper present in structural member 10 is in the amount of 1.96 wt % to 23.08 wt %, preferably in the range of about 7.4 to 13.04 wt % of the article 10.

After the sintering and the infiltration process, the article 10 formed typically has the following composition: 1.96 wt % to 23.08 wt % Cu, 0.010 to 1.000 wt % P with balance essentially Fe and a final density in the range of 6.1 to 8.1 g/cc. It must be understood that article made using the present invention may include other intended elements or compounds well known in the iron alloying, that will enhance the properties of the material.

As discussed above, experiments conducted on industry standard tensile bars made from the sintered powder metal exhibited superior elongation and mechanical strength. The following experiments were conducted to test the mechanical properties of these bars prepared using above sintered powder metal in accordance with the teachings of the present invention.

EXAMPLE NO 1

Tensile bars were made with two different ferro-phosphorus matrix densities and various amounts of copper infiltration. The MPIF standard test method (Standard 10, 1993 revision) and flat test bar geometry was used. The bars were placed in an Instron model 4200 ball screw type load frame with pinching type grips. An Epsilon extensometer, model 3542, 1.00 in. (25.4 mm) gage, +50% to −25% travel, was placed in the middle of the reduced section. The least width and depth of each sample was measured, recorded and input in the Instron program for calculating mechanical properties from the measured stress strain curve. Each sample was pulled at a constant rate of 0.015 in./min. (0.381 mm/min.) until they catastrophically failed.

Figure 4:
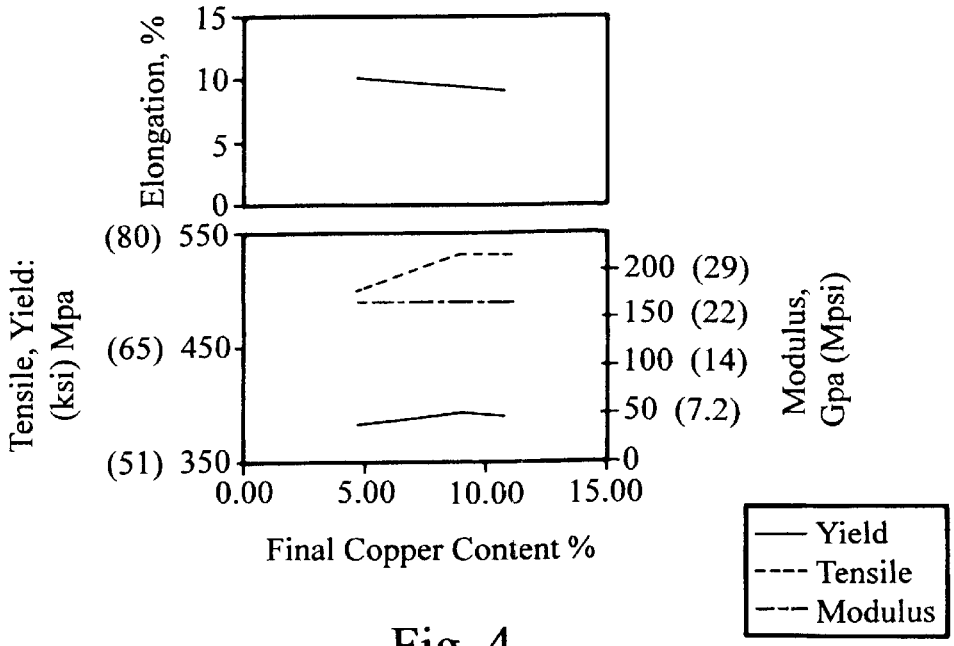
FIG. 4 is a representation of the measured mechanical properties for a 7.0 g/cc density matrix of the compacted iron-phosphorous at various levels of infiltrated copper yielding a range of final density, in accordance with the teachings of the present invention.

Test data were as follows: Measured mechanical properties for the structural member are shown in FIGS. 4 and 5. Data shows that a higher density with equivalent copper content yields better performance. Also, for a given matrix density (each plot represents a constant matrix density) increased copper fill improves performance.

EXAMPLE NO 2

Charpy bars molded of ferro-phosphorous powder in two different compositions/densities were made (5 bars per group). They were sintered and infiltrated with different amounts of copper. The test method and Charpy bar geometry was standard to the powder metal industry (MPIF Standard 40, 1993 revision).

Test data were as follows. The first group's average Impact strength was 159 N-m for 10.7 wt % Cu, 0.42 wt % P with balance Fe and a final density of 7.7 g/cc (this corresponds to a matrix density of 7.0 g/cc and 12.0 wt % copper per matrix). Second group measured 50 N-m for a 13.0 wt % Cu, 0.39 wt % P with balance essentially Fe and a final density of 7.4 g/cc (this corresponds to a matrix density of 6.5 g/cc and 15.0 wt % copper per matrix).

The following chart illustrates the high performance of a structure made from the sintered powdered material of the present invention. In order to illustrate the superior impact strength, elongation and modulus of the structural member made from the present sintered metal powder is compared to most. commercial Powder Metal alloys made by equivalent processing. As the data indicates the structural member of the present invention has excellent stiffness, impact strength, and/or elongation. The following data are limited to two compositions/densities of the structural member. This limited number of data points is not intended to limit the invention to the useful compositions/densities.

In the chart below, examples 1–4 are prior known iron based powder metals. Examples 5–7 are structural material formed of the copper infiltrated iron-phosphorous composite in accordance with the teachings of the present invention.

| Material Description | Material Specification | Tensile Strength MPa (ksi) | Yield Strength MPa (ksi) | Elongation % 1 in gage | Impact N-m (ft-lbs) | Modulus GPa (Mpsi) |
|---|---|---|---|---|---|---|
| 1. Low Cost P/M Material:) | FE—C (F0008-35) 7.0 g/cc final density | 393 (57) | 276 (40) | 1 | 7 (5) | 141 (20.5) |
| 2. Premium P/M Material. | Fe—C—Ni (FN0205) 7 0 g/cc final density | 365 (53) | 221 (32) | 3 | 20 (15) | 141 (20.5) |
| 3. Cu Infiltrated P/M | Cu infiltrated Fe, (FX 1005-40) 6.5 g/cc final density | 531 (77) | 345 (50) | 4 | 18 (13) | 162 (23.5) |
| 4 Commercial Fe—P Material No Cu | Fe—P, 7.0 g/cc final density | 310 (45) | 221 (32) | 7 | 43 (32) | ? |
| 5 Cu Infiltrated Fe—P matrix Excellent Machinability, Good Strength & Elongation | 13% Cu 6.5 g/cc matrix density | 469 (68) | 345 (50) | 7.8 | 50 (37) | 138 (20) |
| 6. Cu Infiltrated Fe—P matrix Excellent Elongation, Good Strength | 7.4% Cu 7.0 g/cc matrix density | 517 (75) | 379 (55) | 10.3 | Not tested | 162 (23.5) |
| 7 Cu Infiltrated Fe—P matrix: Excellent Modulus, Excellent Strength and impact | 10.7% Cu 7.0 g/cc matrix density | 513 (77) | 393 (57) | 9 | 159 (117) | 166 (24) |

The foregoing discussion discloses and describes a preferred embodiment of the invention. One skilled in the art will readily recognize from such discussion, and from the accompanying drawings and claims, that changes and modifications can be made to the invention without departing from the true spirit and fair scope of the invention as defined in the following claims.

What is claimed is:

1. A copper infiltrated iron-phosphorous powder metal article, the article having a composition comprising:

an iron-phosphorous metal powder wherein the iron-phosphorous powder metal is compacted to a matrix, wherein the matrix has a density in the range of 6.0 to 7.2 g/cc;

copper in the range of 1.96 wt % to 23.08 wt % of the article wherein the copper is infiltrated into the matrix; and wherein the article after copper infiltration has a final density in the range of 6.1 to 8.1 g/cc; and wherein an effective amount of phosphorous is present in the iron-phosphorous powder metal to facilitate the infiltration of the copper into the matrix.

2. The article of claim 1, wherein the matrix has a density range of 6.5 g/cc to 7.0 g/cc.

3. The article of claim 1, wherein the effective amount of phosphorous in the iron phosphorous metal powder is in the range of 0.01 wt % to 1.2 wt % of the iron-phosphorous powder metal.

4. The article of claim 1, wherein the amount of phosphorous in the article after copper infiltration is in the range of 0.010 wt % to 1.000 wt % of the article.

5. The article of claim 1, wherein the amount of copper in the article after copper infiltration is in the range of 7.4 wt % to 13.04 wt % of the article.

6. The article of claim 1, wherein the copper in contact with the matrix before copper infiltration is in the range of 2.0 wt % to 30.0 wt % of the matrix.

7. The article of claim 1, wherein the copper is infiltrated during sintering of the matrix.

8. The article of claim 1, wherein the copper is infiltrated after sintering of the matrix.

9. The article of claim 1, wherein the article has an elongation in the range of 4.0% to 30.0%.

10. The article of claim 1, wherein the article has a tensile strength in the range of 310 MPa to 690 MPa.

11. The article of claim 1, wherein the article has an impact strength in the range of 20 N-m unnotched Charpy to 203 N-m notched Charpy.

12. The article of claim 1, wherein the article has a modulus in the range of 138 GPa to 207 GPa.

13. The article of claim 1, wherein the article has yield strength in the range of 220 MPa to 655 MPa.

14. A powder metal structure, the structure comprising:

a copper infiltrated iron phosphorous powder metal composite having a composition of:

an iron-phosphorous metal powder having phosphorous in the range of 0.01 wt % to 1.2 wt %, not more than 0.50 wt % of carbon, and balance substantially iron by weight of the iron-phosphorous metal powder;

wherein the iron-phosphorous metal powder is compacted to a matrix, wherein the matrix has a density in the range of 6.5 to 7.0 g/cc;

copper in the range of 2.0 wt % to 30.0% wt % of the matrix wherein the copper is placed in contact with the matrix and infiltrated into the matrix;

wherein the amount of phosphorus in the structure after copper is infiltrated into the matrix in the range of 0.010 wt % to 1.000 wt % of the structure;

wherein the amount of copper after copper is infiltrated into the matrix is in the range of 1.96 wt % to 23.08 wt % of the structure;

wherein the structure has a density in the range of 6.1 to 8.1 g/cc.

15. The structure of claim 14, wherein the amount of copper after copper is infiltrated into the matrix is in the range of 7.4 wt % to 13.04 wt % of the structure.

16. The structure of claim 14, wherein the copper is infiltrated during sintering of the matrix.

17. The structure of claim 14, wherein the copper is infiltrated after sintering of the matrix.

18. The structure of claim 14, wherein the structure has an elongation in the range of 4.0% to 30.0%.

19. The structure of claim 14, wherein the structure has a tensile strength in the range of 310 MPa to 690 MPa.

20. The structure of claim 14, wherein the structure has an impact strength in the range of 20 N-m unnotched Charpy to 203 N-m notched Charpy.

21. The structure of claim 14, wherein the structure has a modulus in the range of 138 GPa to 207 GPa.

22. The structure of claim 14, wherein the structure has yield strength in the range of 220 MPa to 655 MPa.

23. A process for forming copper infiltrated iron-phosphorous powder metal structural member the structural member having a predetermined shape, comprising the steps of:

blending a phosphorous powder with an iron based metal powder to form a iron-phosphorous powder metal, the phosphorous powder being present in the range of 0.01% to 1.2% by weight of the iron-phosphorous powder metal;

compacting the iron-phosphorous powder metal into a preform having a density in the range of 6.0 and 7.2 g/cc;

infiltrating copper into the preform, the copper after infiltration is present in an amount in the range of 1.96 wt % to 23.08 wt % of the structure; and wherein the structural member after copper infiltration has a density in a range of 6.1 g/cc to 8.1 g/cc.

24. The process of claim 23, further comprising the step of simultaneously sintering the preform during the step of infiltrating copper into the preform.

25. The process of claim 23, further comprising the step of sintering the preform before the step of infiltrating copper into the preform.

26. The process of claim 23, wherein the amount of phosphorous after infiltrating copper is in the range of 0.01 wt % to 1.000 wt % of the structural member.

27. The process of claim 23, wherein the amount of copper after infiltrating copper is in the range of 7.4 wt % to 13.04 wt % of the structural member.

28. The process of claim 23, wherein the amount of copper before infiltrating copper is in the range of 2.0 wt % to 30.0 wt % of the preform.

29. The process of claim 23, wherein the structural member has an elongation in the range of 4.0% to 30.0%.

30. The process of claim 23, wherein the structural member has a tensile strength in the range of 310 MPa to 690 MPa.

31. The process of claim 23, wherein the structural member has an impact strength in the range of 20 N-m unnotched Charpy to 203 N-m notched Charpy.

32. The process of claim 23, wherein the structural member has a modulus in the range of 138 GPa to 207 GPa.

33. The process of claim 23, wherein the structural member has yield strength in the range of 220 MPa to 655 MPa.

* * * * *